US005548468A

United States Patent [19]

Shirakawa et al.

[11] Patent Number: 5,548,468

[45] Date of Patent: Aug. 20, 1996

[54] SURGE ARRESTER USING ZINC OXIDE ELEMENTS INSTALLED IN PARALLEL, AND METHOD OF FORMING THE SURGE ARRESTER

[75] Inventors: Shingo Shirakawa; Satoshi Watahiki, both of Hitachi, Japan

[73] Assignee: Hitachi, Ltd., Tokyo, Japan

[21] Appl. No.: 271,654

[22] Filed: Jul. 7, 1994

[30] Foreign Application Priority Data

Jul. 14, 1993 [JP] Japan ..... 5-173946

[51] Int. Cl.[6] ..... H04H 1/04

[52] U.S. Cl. ..... 361/126; 361/117; 338/21; 338/235; 29/613

[58] Field of Search ..... 361/120, 126, 361/127, 117–119, 128–132; 338/20–21, 235; 29/610.1, 613

[56] References Cited

U.S. PATENT DOCUMENTS 4,814,936 3/1989 Ozawa et al. ..... 361/127

5,359,316 10/1994 Ozawa et al. ..... 338/21

FOREIGN PATENT DOCUMENTS 56-91402 7/1981 Japan .

56-164502 12/1981 Japan .

*Primary Examiner*—Howard L. Williams

*Assistant Examiner*—Michael J. Sherry

*Attorney, Agent, or Firm*—Fay, Sharpe, Beall, Fagan, Minnich & McKee

[57] ABSTRACT

An arrester has a plurality of laminated columns arranged in parallel, each having a plurality of nonlinear conduction elements. The columns are electrically interconnected by conductive connection members so that a conduction path is defined by the conduction elements and the connection members. The columns are arranged around, and in contact with, an insulating support column, which provides mechanical strength for the arrester. A plurality of such arresters may be arranged in an array, the arresters being interconnected by further insulating support columns. The laminated columns also contain insulating spacers and the spacers of two or more laminated columns may be rigidly interconnected. The arresters may be mounted in a casing filled with an insulating gas.

19 Claims, 6 Drawing Sheets

FIG. 3a
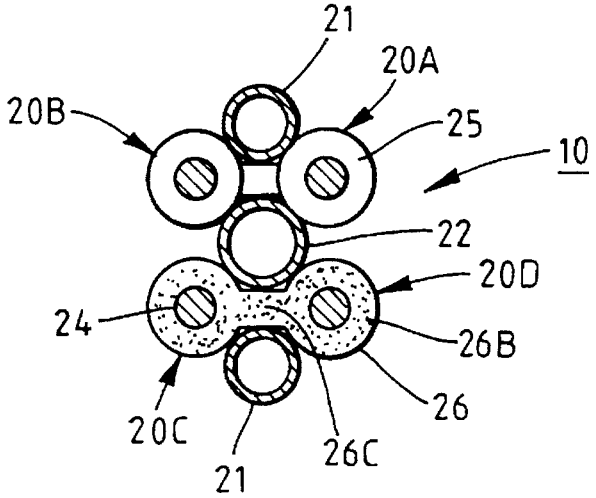
FIG. 3b
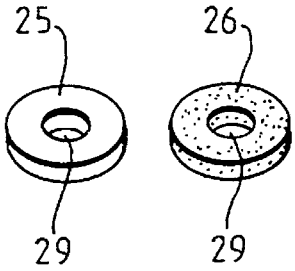
FIG. 3c
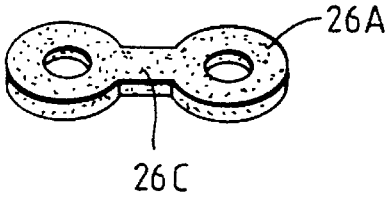
FIG. 3d
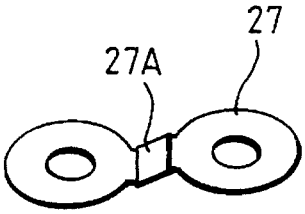
FIG. 5
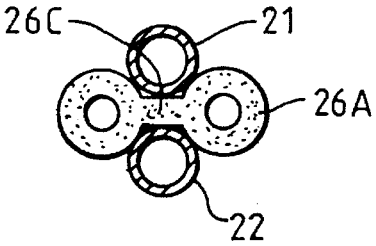
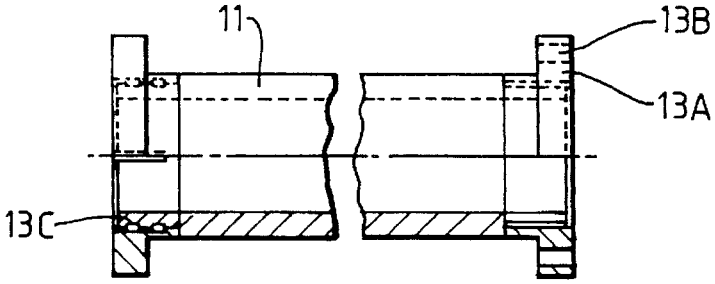
FIG. 6

SURGE ARRESTER USING ZINC OXIDE ELEMENTS INSTALLED IN PARALLEL, AND METHOD OF FORMING THE SURGE ARRESTER

BACKGROUND OF THE INVENTION

1. Field of the Invention

The present invention relates to an arrester, which may be used, for example, as an over-voltage suppression unit in an electric power transmission system. The present invention also relates to an arrester assembly incorporating a plurality of arresters, and to a method of forming an arrester assembly.

2. Summary of the Related Art

It is normal to transmit electric power from the site at which it is generated, e.g. a power station, to the sites where it is to be used, by overhead cables. If such cables are struck by lightning, an over-voltage appears on the cables which may result in damage to electrical devices connected to the transmission system. For this reason, it is common to connect one or more arresters to electrical power transmission systems, which arresters act as overvoltage suppression devices.

There are many different types of arresters. In one known type, the arrester is in the form of a column, having a plurality of conductive elements which are laminated together. The conductive elements have a non-linear characteristic. This may be achieved by making them of a suitable material, such as zinc oxide. In known examples of such arresters, the conductive elements have an annular cross-section and are mounted on an insulating rod.

The over-voltage suppression effect of such an arrester depends on the number and thickness of the conductive elements. In order to prevent the arrester from becoming too long, it has been proposed that a plurality of laminated columns be provided, arranged in parallel, with the columns being electrically connected together. In this way, by forming a conduction path extending along and between the columns (by use of suitable electrical connection members interconnecting the columns at intermediate points along their length), it is possible to provide a sufficiently long conduction path without making the arrester excessively long. Examples of such arresters are disclosed in JP-A-56-91402 and JP-A-56-164502.

SUMMARY OF THE PRESENT INVENTION

Although an arrester comprising a plurality of laminated columns has the advantage that the overall length of the arrester can be minimized, it has been found that the length remains sufficiently long that the arrester is vulnerable to mechanical shock. If a mechanical shock, such as an earthquake, is applied to the arrester, the columns will vibrate and may be broken. This is a particular problem if protection against very high over-voltages is needed, since then the length of the arrester is long, even if it is formed by a plurality of columns electrically interconnected together.

Therefore, in accordance with a first aspect of the present invention, the columns of the arrester are arranged around a support column, and are connected thereto. The support column adds to the mechanical strength of the arrester, thereby reducing the risk of damage. Normally, the support column will be of an insulating material.

Although it is possible for the support column to be solid, it has been found that sufficient strength may be provided by a hollow support column, permitting the weight of the arrester to be kept as low as possible. As in the existing systems, the non-linear conduction elements used in each laminated column may be of zinc oxide, be annular, and be mounted on an elongate insulating core (insulating rod).

In the known arresters, such as disclosed in JP-A-56-91402 or JP-A-56-164502, the laminated columns also have insulating spacers which separate the conduction elements into groups along each laminated column. Each of such groups may have as few as one conduction element, but will normally have more. Therefore, in accordance with a second aspect of the present invention, such spacers of pairs of laminated columns are rigidly connected together by insulating material, thereby adding greater mechanical strength to the arrester.

Thus, both the first and second aspects of the present invention provide support for the laminated columns at one or more points along the length thereof, rather than just at the ends thereof. The first and second aspects of the present invention are independent, but may be used in combination, if desired.

Preferably, an arrester according to the first and/or second aspect of the present invention forms part of an arrester assembly, in which one or more arresters are enclosed within a casing. Such a casing may be filled with an insulating gas, such as $SF_6$. Where the arrester assembly comprises a plurality of arresters, they may be arranged in parallel and interconnected by further support columns, which further support columns contact laminated columns of at least two of the arresters. Hence, such further support columns increase the mechanical strength of the arrester assembly as a whole. Again, the further support columns are normally insulating.

In such an arrester assembly, the arresters may extend the full length of the casing, but it is preferable that two arrester arrays are provided, each array incorporating one or more arresters, with the arrays being arranged coaxially and connected by suitable connection means. The connection means may then permit some relevant movement of the arrester arrays, e.g. by providing some resilience in the connection means, and this then reduces further the risk of damage to the arrester assembly due to vibration. The use of such coaxial arrester arrays thus represents a third aspect of the present invention, although it may be combined with the first and/or second aspects of the present invention.

The third aspect of the present invention also permits the arrester assembly to be constructed with the minimum risk of damage to the arresters. If the arresters extended the full length of the casing, they would have to be inserted into the casing from one end thereof, and if the arresters extended horizontally there would be significant torsional stress applied thereto due to gravity. If the arrester assembly has two arrester arrays, they can be inserted from opposite directions into the casing and secured together only when they are within the casing. Since the length of each arrester array is approximately half the total length needed, the stresses to which each arrester array is exposed are thus reduced. This method of construction is thus a fourth aspect of the present invention.

It should be noted that, where two such arrester arrays are provided and are connected by suitable connection means, there is the risk that relative movement of the arrester arrays will generate particles (e.g. of metal) which could contaminate the arrester arrays and increase the risk of electrical breakdown. Therefore, if the arrester assembly is positioned with the arresters extending horizontally, a recess may be provided in the interior of the casing below the connection means interconnecting the arrester arrays, which recess receives the particles and thus reduces the risk of contamination.

To reduce further the risk of electrical breakdown, it is preferable that the electrical connection to the arrester(s) be made via a shield ring extending around the arresters. That shield ring may be connected to the arrester(s) at one end thereof and connected at the other end thereof to an electrical connection to an external object. This represents a further, independent, aspect of the present invention.

BRIEF DESCRIPTION OF THE DRAWINGS

Embodiments of the present invention will now be described in detail, by way of example, with reference to the accompanying drawings, in which:

FIGS. 3(*a*) to 3(*d*) show components of the arrester of FIG. 2, FIG. 3(*a*) being a sectional view through the arrester of FIG. 2, FIG. 3(*b*) showing a conductive element and a spacer, FIG. 3(*c*) showing a pair of spacers connected together, and FIG. 3(*d*) showing a connector for electrically connecting adjacent laminated columns;

FIG. 5 shows an alternative arrangement for insulating columns in the embodiment of FIG. 1;

FIG. 6 is a cross-sectional view showing the construction of a support bar for use in the embodiment of FIG. 1;

DETAILED DESCRIPTION

A first embodiment of the present invention will now be described, referring to FIGS. 1 to 11.

Figure 1:
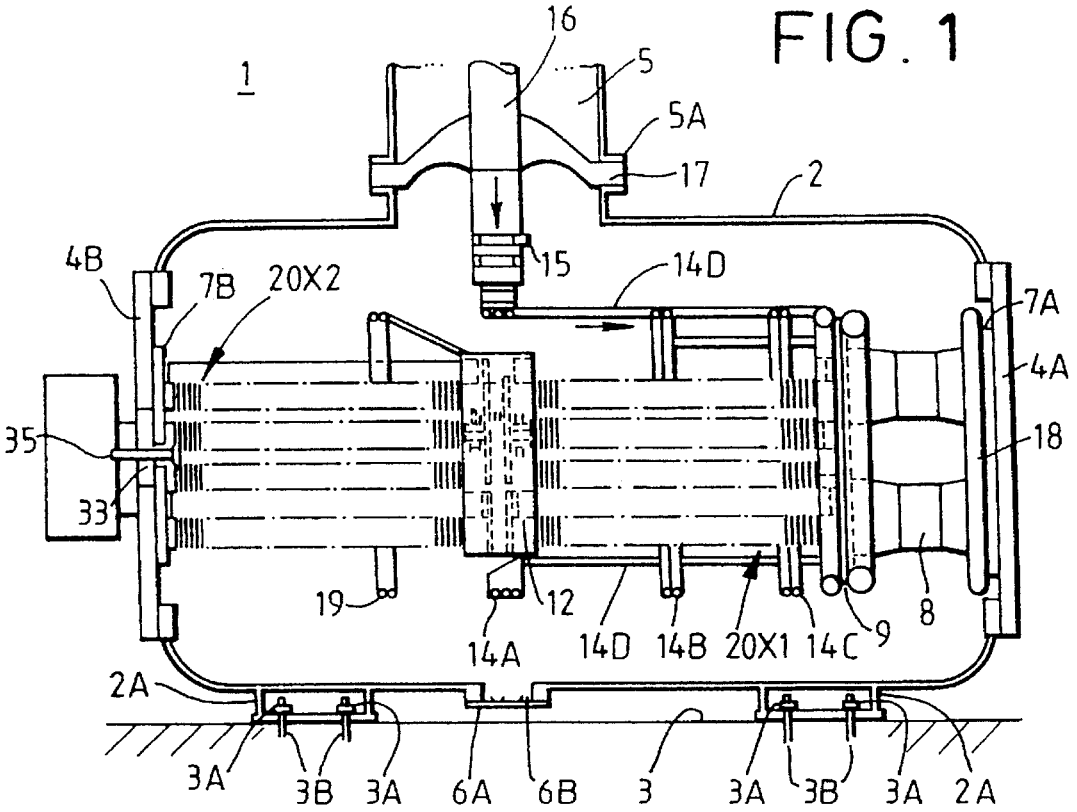
FIG. 1 shows a cross-sectional view through an arrester assembly as a first embodiment of the present invention.

FIG. 1 shows a gas insulating tank arrester assembly, with a cylindrical casing 2. Bolts 3B, on an installation surface 3, are inserted into leg parts 2A of the casing 2 to fix the leg parts 2A to the installation surface 3 by tightening nuts 3A. The casing 2 has openings at each end thereof, which are closed by end plates 4A, 4B. The interior of the casing 2 is thus air-tight, and is filled with an insulating medium such as $SF_6$ insulating gas.

The casing 2 contains two arrester arrays 20X1 and 20X2, respectively a high voltage side array and a low voltage side array.

Figure 2:
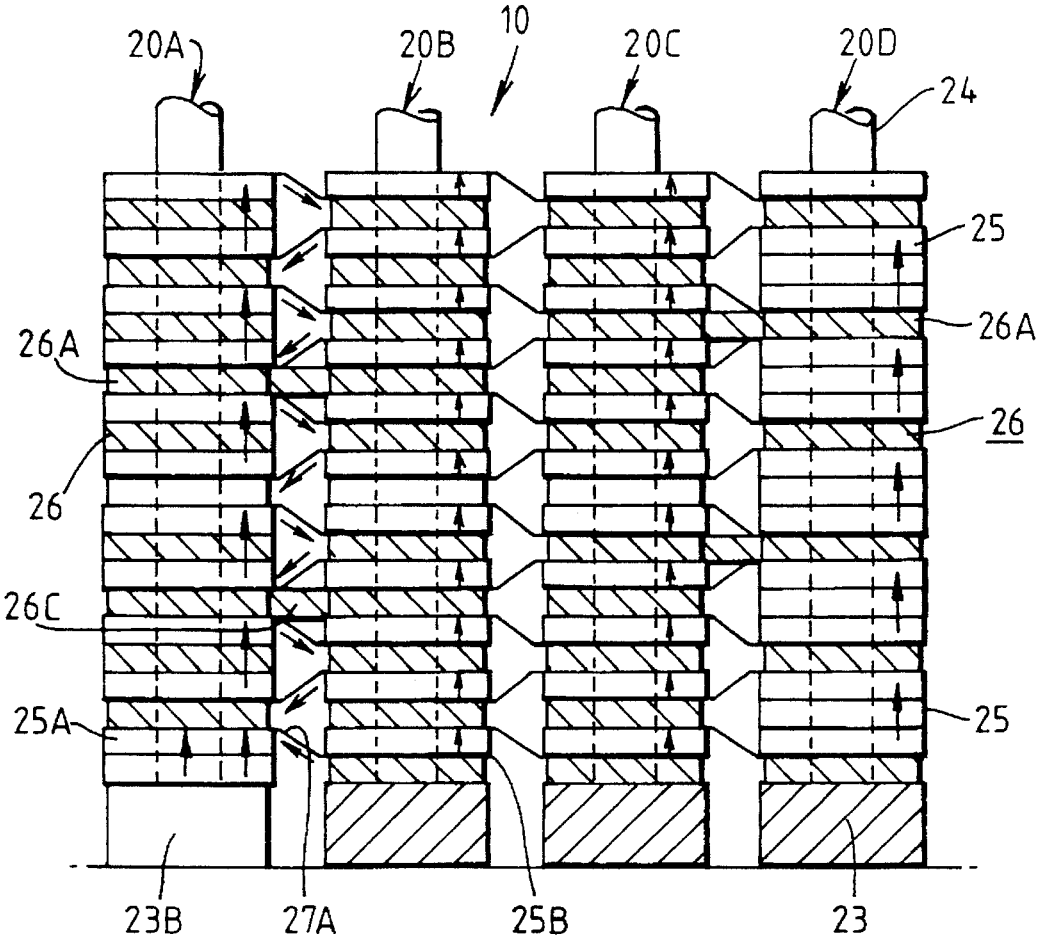
FIG. 2 shows an arrester for use in the embodiment of FIG. 1 comprising a plurality of laminated columns.

The detailed structure of these arrester arrays 20X1, 20X2 will now be described in more detail. Each arrester array 20X1, 20X2 comprises a plurality of arresters 10, each of which is as shown in FIG. 2. In this embodiment, the arresters 10 each comprise four laminated columns 20A, 20B, 20C and 20D which extend parallel to each other. Each laminated column 20A, 20B, 20C, 20D has a plurality of annular non-linear conductive elements 25, made of, for example, zinc oxide, which are mounted on insulating rods 24. Insulating spacers 26 are also provided along the rods 24, and electrically conductive connection members 27A (for example, made of copper) interconnect a conductive element 25A of one arrester to a conductive element 25B of another arrester. The connection members 27A are arranged, as shown in FIG. 2, so that a continuous electrical path is defined from an input side connecting conductor 23B which passes through each conductive element 25 of all four columns 20A, 20B, 20C and 20D. Thus, a long conductive path is formed by the arrester 10. FIG. 2 also shows insulating end spacers 23.

FIG. 2 does not show the geometrical arrangement of the columns 20A, 20B, 20C and 20D, but this is shown more clearly in FIG. 3(*a*). FIG. 3(*a*) shows that the four columns 20A, 20B, 20C and 20D are arranged around an insulating column formed by a hollow insulating support cylinder 22, and are secured thereto. The insulating support cylinder 22 thus provides increased mechanical strength for the arrester 10.

FIG. 3(*b*) shows the annular structure of the conductive elements 25 and spacers 26. As can be seen, each has a hole 29 therein, through which passes the insulating rod 24. However, some of the spacers have the structure shown in FIG. 3(*c*) in which two annular spacers 26 are rigidly interconnected by an insulating connection 26C to form a spacer structure 26A. As shown in FIG. 2, the insulating connection 26C thus interconnects pairs of the columns 20A, 20B, 20C and 20D, thereby providing increased strength to the arrester 10.

FIG. 3(*d*) shows that the connection member 27A forms part of a conductive unit 27 comprising a pair of annular rings connected by the connection member 27A. The annular rings of the unit 27 are thin, and thus cannot be seen in FIG. 2, but are clamped between a conductive element 25 and an adjacent spacer 26, so that there is good electrical connection between a conductive element 25 and the connection member 27A.

FIG. 3(*a*) also shows further insulating columns formed by further hollow cylinders 21. The purpose of these cylinders 21 can be seen from FIG. 4, namely to provide a connection between pairs of arresters 10. Thus, each arrester assembly 20X1, 20X2 comprises four arresters 10, each comprising four columns 20A, 20B, 20C and 20D.

It should also be noted that, in FIG. 3(*a*), the insulating connection 26C of the spacer structure 26A is sufficiently narrow that it does not contact the cylinder 22, but contacts the cylinder 21 because that cylinder 21 has a smaller diameter. However, as shown in FIG. 5, it is also possible for the insulating connection 26C to contact both cylinders 21, 22.

Returning now to FIG. 1, a high voltage side sheath 5 is provided in the top of the casing 2, and a cover 6A closes a recess in the inside wall of the casing at the bottom of the casing. An attracting member 6B may be provided in the cover 6A for collecting metallic particles produced by springs or by metal-to-metal contact during transportation of the arrester assembly 1 in order to prevent any degradation in reliability of the insulation.

The high voltage side sheath 5 extends upwardly from the top of the casing 2, and a high voltage side conductor 16 extends within the sheath 5. The high voltage side conductor 16 is supported by an insulator spacer 17 which is received between opposed flanges 5A in the high voltage side sheath 5, and is connected to the high voltage sheath 5 through adjusting hardware 15. The high voltage side adjusting hardware 15 permits adjustment of the distance between the high voltage side conductor 16 and a ring 14A of the high voltage side shield ring. The elongate conductors 14D extend from the ring 14A toward an installation plate 7A at suitable intervals (approximately 90° intervals) around the rings 14A, 14B, 14C. Thus, the rings 14A, 14B, 14C and the elongate conductors 14D enclose the high voltage side arrester array 20X1, which is connected to a high voltage side support plate 9. This enclosure of the high voltage side arrester array 20X1 by the shield ring makes the electric potential burden thereof uniform.

An earth side shield 18 encircles the installation plate 7A and a part of the insulating cylinders 8 and, at the same time, is attached to the end plate 4A to be supported. A middle shield 19 encircles a connection means 12 and the low voltage side arrester array 20X2 to make the electric potential burden thereof uniform, and is attached to the connection means 12 to be supported thereby.

The installation plate 7A and a mounting plate 7B are attached to the end plates 4A, 4B. A plurality of insulating cylinders 8 are attached to the installation plate 7A on the right hand side. The insulating cylinders 8 are insulated from ground, and can concurrently withstand voltages of normal operation. Four arresters 10 (as previously described) and four insulating support bars 11 extend between the support plate 9, attached to the insulating cylinders 8, and the connection means 12, and four further arresters and four further insulating support rods extend between the connection means 12 and the low voltage side mounting plate 7B.

Figure 7:
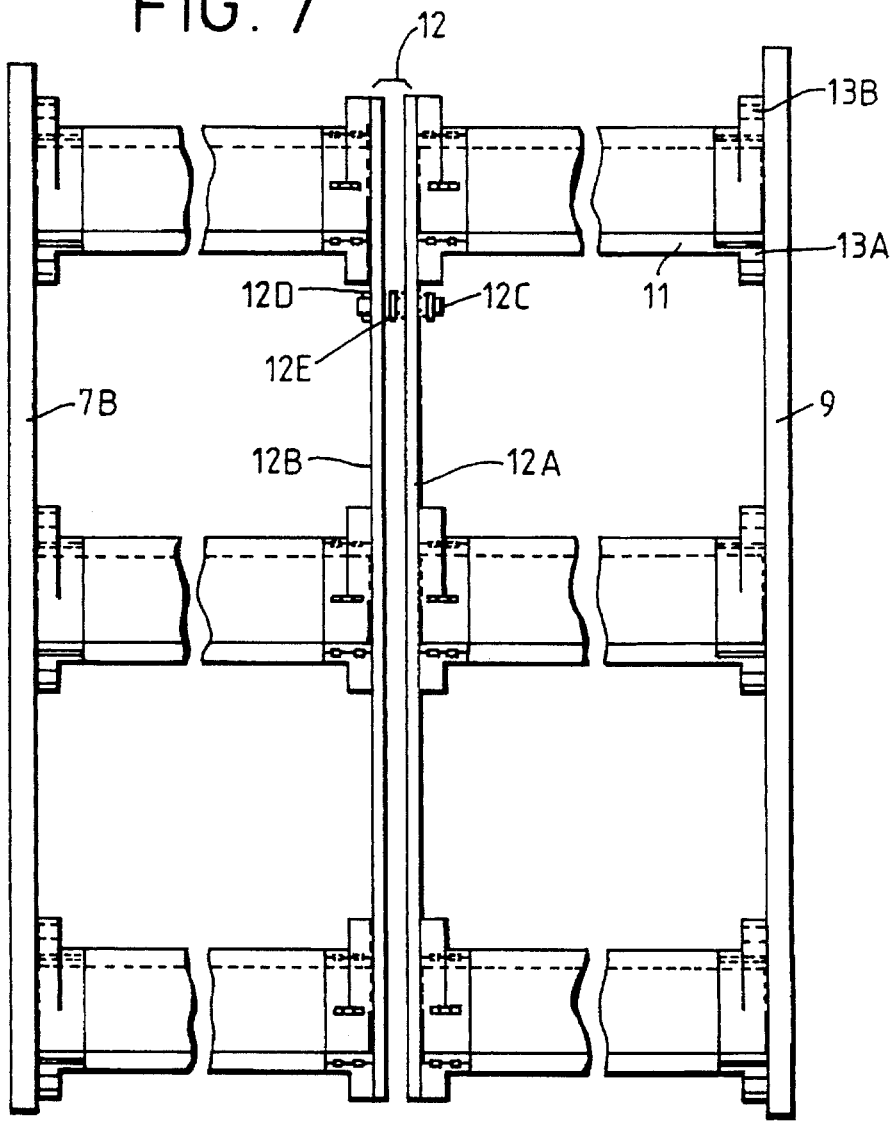
FIG. 7 illustrates the interconnection of groups of support bars in the embodiment of FIG. 1.
Figure 10:
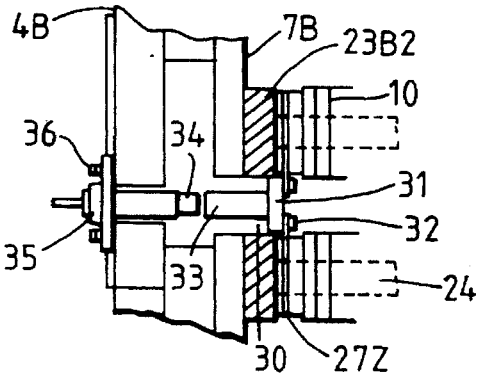
FIG. 10 is a cross-sectional view showing the ground connection in the embodiment of FIG. 1.
Figure 11:
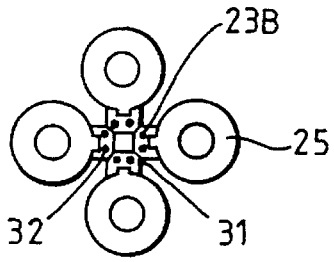
FIG. 11 is a cross-sectional view showing the ground terminal in the embodiment of FIG. 1.

The four insulating support bars 11 are arranged on the support plate 9 or mounting plate 7B around the arresters 10 with approximately 90° interval therebetween. The high voltage side support plate 9 is formed of a metallic member. Attaching flanges 13A are attached to the surfaces on the high voltage side support plate 9, the low voltage side mounting plate 7B and the connection means 12 using screws 13B as shown in FIGS. 6 and 7. The insulating support bars 11 are inserted into a hollow part provided on the attaching flange 13A and fixed to the attaching flange 13A by for example, pouring adhesive 13C in a groove on the inside surface of the hollow portion of the attaching flange 13A.

FIG. 7 also shows that the connection means 12 comprises a pair of connection plates 12A, 12B extending parallel to each other, in a direction generally perpendicular to the insulating support bars 11.

A nut is attached to a bolt 12C penetrating the connection plates 12A and 12B, and is tightened to secure together the connection plates 12A, 12B. The nut 12D is attached to the bolt 12C through dished springs 12E inserted between the connection plates 12A and 12B, the dished springs 12 permitting the force between connection plates 12A and 12B to be adjusted.

Figure 8:
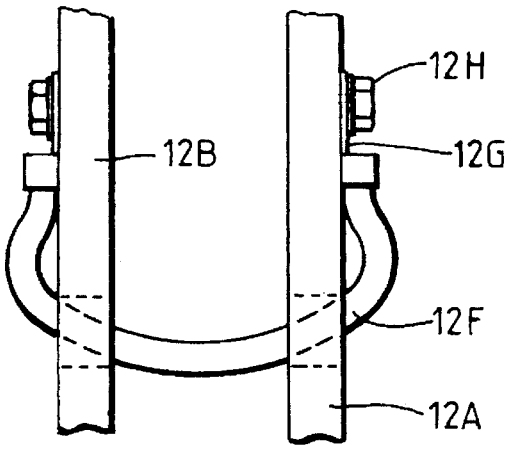
FIG. 8 shows the interconnection between support plates in the embodiment of FIG. 1.

As shown in FIG. 8, screws 12H secure terminals 12G, provided on both ends of a flexible conductor 12F, to the connection plates 12A and 12B to provide electrical connection therebetween via the conductor 12F.

Although not shown in FIGS. 6 to 8, four arresters 10 are provided in a square arrangement among the insulating support bars 11, being supported by the supporting member 12 and either the low voltage side mounting plate 7B or the support plate 9.

Figure 4:
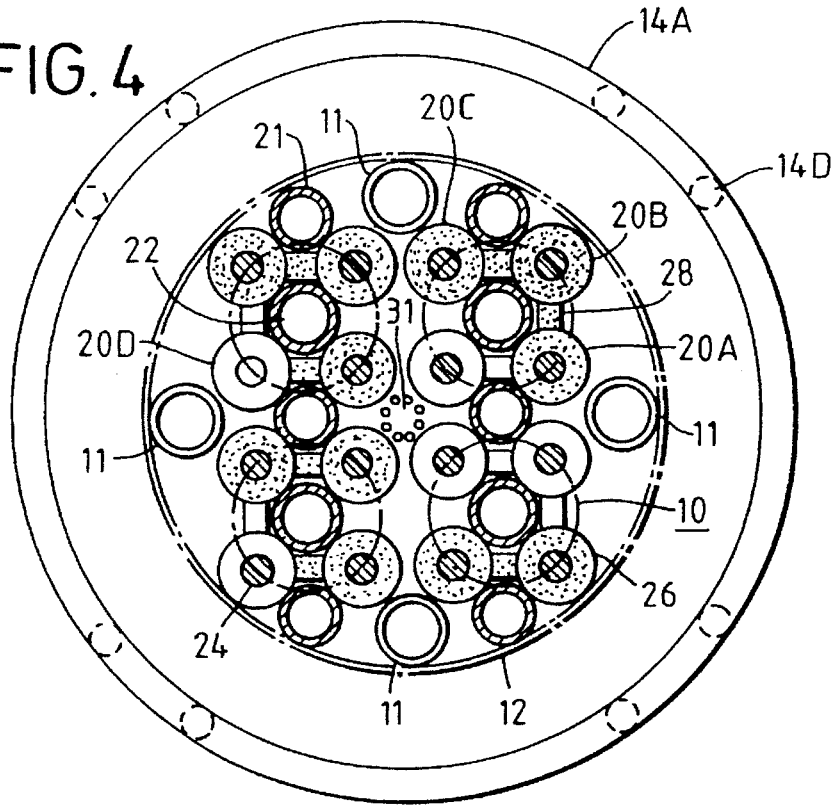
FIG. 4 is a sectional view through an arrester array in the embodiment of FIG. 1.
Figure 9:
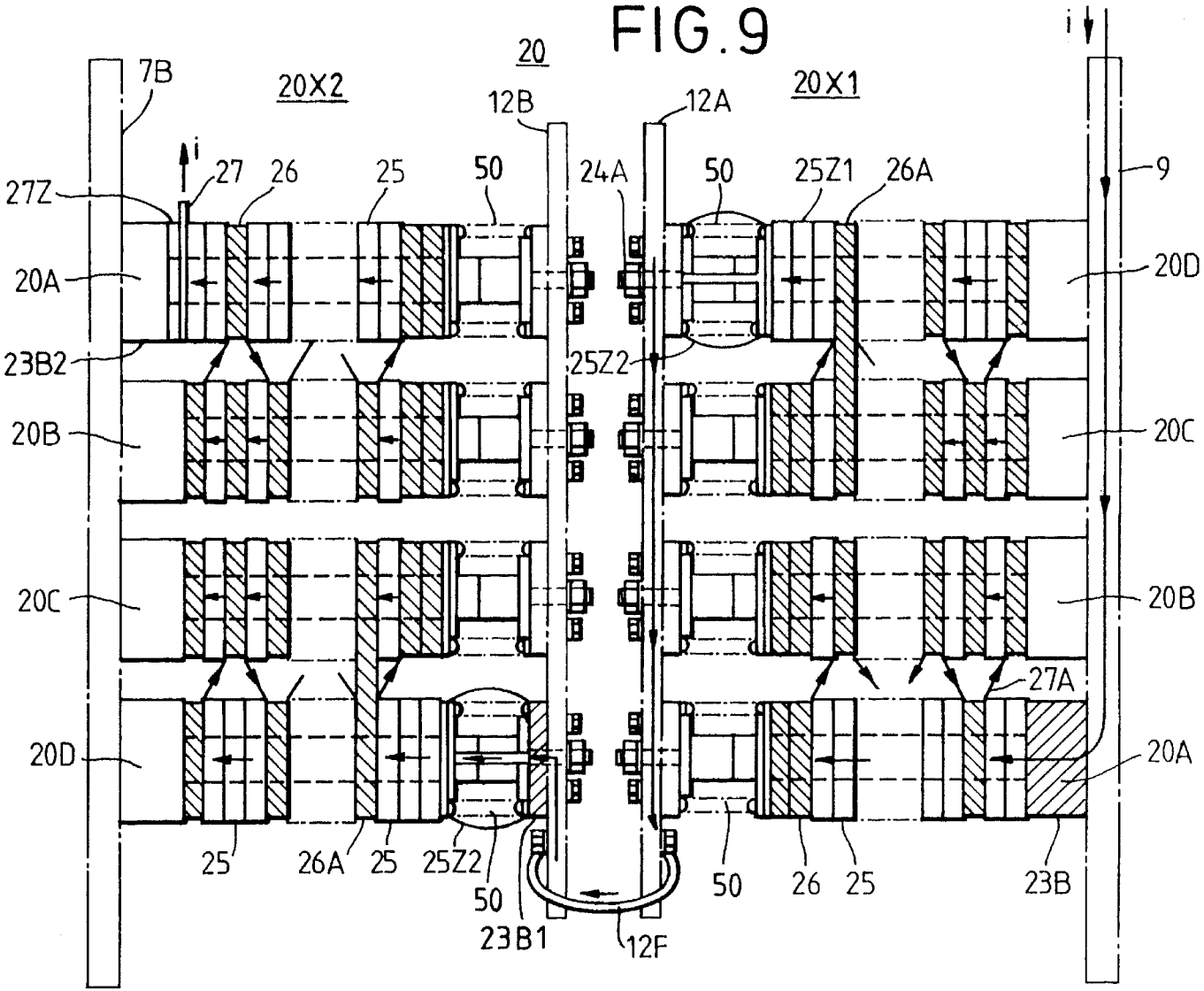
FIG. 9 shows two arrester arrays interconnected together, corresponding to the arrangement of FIG. 1.

As previously described, the arresters 10 are constructed such that four columns 20A, 20B, 20C and 20D are connected step-wise as shown in FIG. 2, and these arresters are arranged around a support cylinder 22 as shown in FIG. 3(*a*). The high voltage side arrester array 20X1 is then formed by connecting four of the arresters 10 in parallel, and similarly the low voltage side arrester array 20X2 is also formed by connecting four arresters 10. The resulting assembly is shown in FIG. 9. Thus, four arresters 10 are arranged in a square array as shown in FIG. 4. Each of the arresters 10 is formed by arranging first to fourth columns 20A to 20D around a corresponding support cylinder 22. The outer diameter of the support cylinder 22 is larger than that of the support cylinder 21 which interconnects the arresters 10. It should also be noted that the component indicated by symbol 27Z is formed of an insulating plate in the low voltage side attaching plate, and, on the other hand, is formed of conductive material in the high voltage side support plate.

The input side connecting conductor 23B is electrically connected to the high voltage conductor 16A as shown in FIG. 9. A plurality of non-linear conductive elements 25 (for example, of zinc oxide), insulating spacers 26 and connecting conductive units 27 are laminated on the insulating rods 24. The insulating spacers 26, the conductive elements 25 and springs 50 are inserted from the top end of the insulating rod 24 of each of the columns 20A, 20B, 20C and 20D one after another. Then, the connection plates 12A, 12B are connected to the insulating rod 24, and tightening bolts 24A attached to the insulating rods 24 are rotated to support the laminated elements 20 between the connection plate 12A and the high voltage side support plate 9, and between the connection plate 12B and the low voltage side mounting plate 7B respectively. In the assembly thus described, the arresters 10 may be assembled in advance in a suitable assembling place outside the casing 2, instead of assembling thence in the small space inside the casing 2. Thus the assembly work can be easily performed and the workability is improved.

The springs 50 are electrically grounded by flexible connecting conductors 25Z2, and connected to the connection plates 12A, 12B respectively. On the other hand, the connection plates 12A and 12B are electrically connected to each other by the flexible conductor 12F.

In the embodiment described above, the conductive elements 25 and the spacers 26 are annular, and are spaced at uniform intervals around the support cylinder 22. It can readily be seen that the shape of the conductive elements 25 and spacers 26 is not critical to the present invention, and they may be other shapes, for example square or oval. Moreover, although four columns 20A, 20B, 20C and 20D are arranged around a single support cylinder 22, to form the arrester 10, again this is not essential to the present invention and any number of columns may be provided around the support cylinder 22, depending on the size of that support cylinder 22 and the columns 20A, 20B, 20C and 20D. It may also be noted that, in FIGS. 2 and 9, the diameters of the spacers 26 are slightly less than the diameters of the conductive elements 25. In such an arrangement, the spacers 26 will be spaced by a small amount from the support cylinder 22, unlike the arrangement shown in FIG. 3(*a*) and FIG. 4. Of course, the support cylinder 22 will still be in contact with each column 20A, 20B, 20C and 20D by contact with the conductive elements 25.

The diameter of the support cylinder 22 is determined by the need for a spacing between the laminated columns 20A, 20B, 20C and 20D to maintain insulation therebetween.

In the present invention, the support cylinder 22 provides structural strength for the arrester 10, by supporting each of the laminated columns 20A, 20B, 20C and 20D. The resistance to vibration, for example due to earthquakes, of the arrester 10 is thereby improved. Further support is given by the connection 26C of insulating material of the spacer units 26A of the laminated columns 20A to 20D, as has also been discussed above.

The conductive connection member 27A, which connects the zinc oxide conductive elements 25 in each of the first to the fourth laminated columns 20A to 20D, is inclined relative to the axes of the laminated columns 20A to 20D, from the top of the conductive element 25A to the bottom of the conductive element 25B, which decreases the length of the laminated column by one conductive element for each conductive connection member 27A. Therefore, the length of the arrester 10 can be decreased.

A hole 30 is provided for the ground terminal part 27Z. The hole 30 penetrates the spacer 23B2, the low voltage side mounting plate 7B and the end plate 4B. A ground terminal 31 is provided at the hole 30 in the center portion enclosed by four of the arresters 10. Hence, positioning of the arresters 10 can be easily performed, and, at the same time, the ground terminal 31 and the ground terminal part 27Z can be connected over the shortest distance. The internal inductance of the arresters 10 can thus be decreased. The ground terminal part 27Z of each of the arresters 10 is fixed to the ground terminal 31 using a bolt 32. A ground conductor 34 is inserted into a ground connecting part 33, for example, such as a tulip-shaped contact, provided on the ground terminal 31 to provide electrical connection. A ground side spacer 35 supports the grounding conductor 34 and is supported by the end plate 4B through a bolt 36.

A ground current I indicated by an arrow in FIG. 9 flows as follows: from the high voltage side conductor 15 to the sheath (14A→14D) to the high voltage side support plate 9 to the high voltage side arrester array column 20X1 to the flexible conductor 12F to the connecting conductor 23B1 to the low voltage side arrester array 20X2 to the ground terminal part 27Z to the ground terminal 31 to the grounding conductor 34.

On the other hand, a discharge current flows from the high voltage side conductor 15 to the sheath (14A→14D) to the high voltage side support plate 9 to the high voltage side arrester array column 20X1. Therefore, the circuit becomes a return circuit, and hence the specific internal inductance of the arrester assembly can be decreased by mutual induction. Also, since the response limit voltage to a sudden surge is generated based on Ldi/dt (L being inductance, di/dt being current change rate), the limit voltage decreases as the induction voltage decreases due to decrease of the internal inductance. Hence the protection characteristic of the arrester assembly is improved.

According to the support system for an arrester assembly in accordance with the present invention, the following effects may be attained.

1. Each of the laminated columns 20A to 20D is arranged around, and in contact with, the insulating cylinder 22. Therefore, each of the laminated columns 20A to 20D has an improved mechanical strength against horizontal and vertical vibrations sufficient to prevent damage of the arrester array, and the protection against earthquakes is therefore improved.

When the arresters are arranged horizontally, as in FIG. 1, the laminated columns 20A and 20B are unlikely to fall and are stable since they are placed between the insulating support cylinders 22 and the further insulating support cylinders 21.

2. Since the insulating support cylinders 22, and also the further insulating support cylinders 22, may support the first to the fourth laminated columns 20A to 20D at four points, the diameter of the arrester can be decreased.

The diameter of the insulating support cylinder 22 is made larger than that of the further insulating support cylinder 21, and it is sufficient to use only one intermediate insulating support cylinder 22 for each arrester 10, which leads to saving in assembly time when assembling the arrester assembly.

3. Four arresters 10 may be provided around a ground terminal 31. Hence, positioning of the arresters 10 can be easily performed, and, at the same time, the ground terminal 31 and the ground terminal part 27Z can be connected, with the shortest distance therebetween. The internal inductance of the arrester assembly can be decreased and the protective characteristic of the arrester assembly is increased.
4. In connecting a zinc oxide conductive element 25A to the adjacent zinc oxide conductive element 25B, a bridging conductive connection member 27A is used with inclined bridging from the top of the zinc oxide conductive element 25A to the bottom of the zinc oxide conductive element 25B to decrease the height of the laminated column by one zinc oxide conductive element. Therefore, the length of the arrester can be decreased and resistance to earthquakes is further improved.
5. The end part of a high voltage side ring sheath is located at the center of the arrester assembly, and an arrester high voltage conductor extends at right angles to the sheath. A concave portion projecting outward on the bottom surface of its tank is provided in the opposite side of the high voltage conductor member. Such a construction can be used with a gas insulating switch. Thus, a gas insulating switch can be made which is capable of connecting to an arrester placed horizontally or vertically in an insulating gas contained earthed tank to protect the switch against a current surge.

Figure 12:
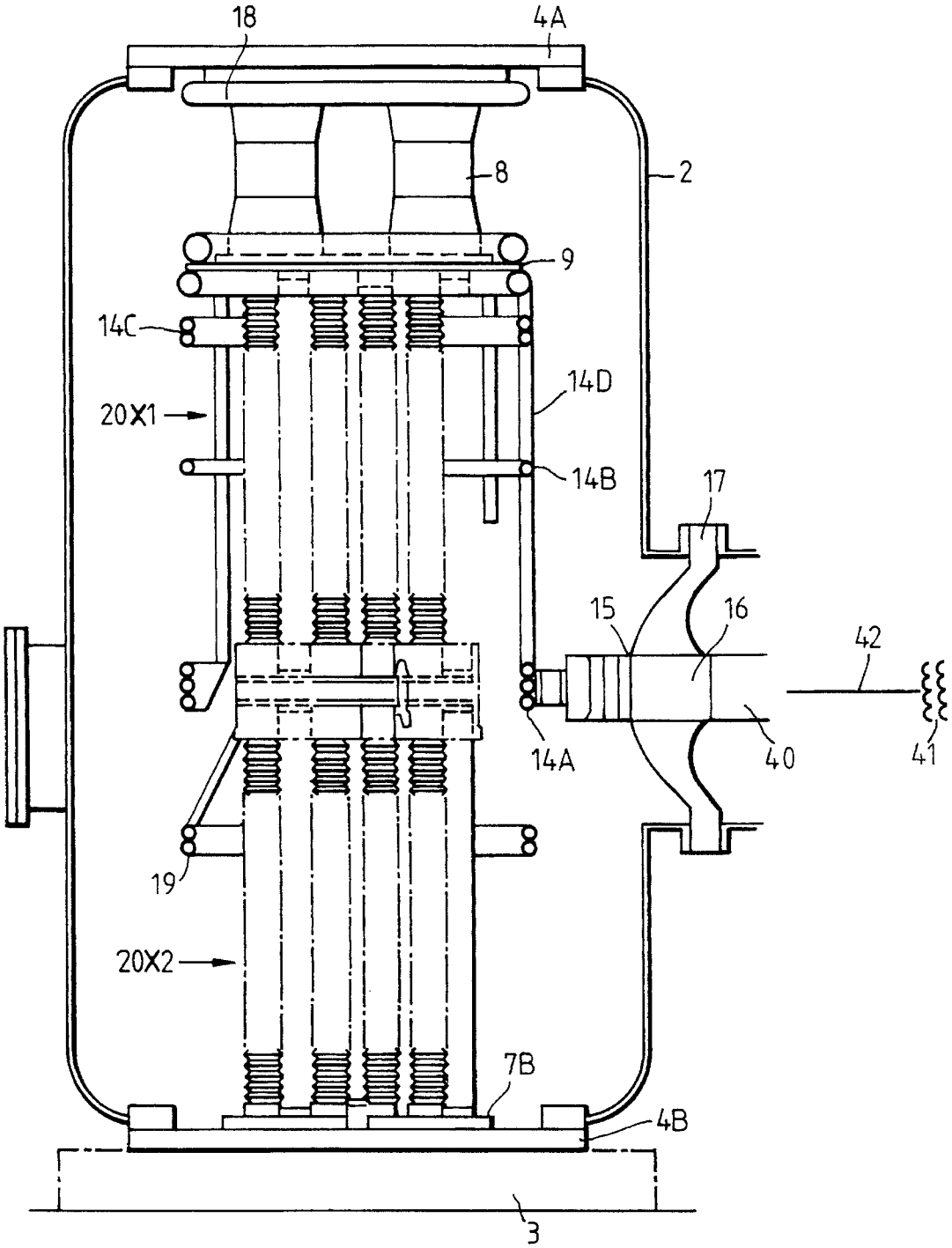
FIG. 12 is a cross-sectional view showing a second embodiment of an arrester assembly according to the present invention.

FIG. 12 shows a second embodiment of the present invention, which is a vertical type arrester assembly. Apart from the orientation of the arrester assembly, the second embodiment of the present invention is generally similar to the first embodiment, and the same reference numerals are used to indicate the corresponding parts.

In this second embodiment, the high voltage conductor 16 is connected to a high voltage side bus bar 40 at a level near the ground. For example, the high voltage conductor can be easily connected to a bus-bar conductor 42 of a transformer 41. This means that the high voltage conductor 16 can be directly connected to a transformer bus bar, and then the bus bar can be shortened, which leads to a decrease in cost. Further, this also permits gas insulating machines of low height, and there is the further advantage that installation work for a transformer can be easily performed.

The arrester according to the present invention can be used also in air, rather than as an insulating gas described in the embodiments above. Furthermore, there is no need to assemble the arrester assembly in a narrow casing; and the assembling work can be easily performed assembling the arrester assembly outside of a grounded casing in advance, installing the assembled arrester in the ground casing, and injecting insulating gas into the ground casing.

Indeed, because the connection means 12 comprises two connection plates 12A, 12B which are secured together as previously described, it is possible to insert the arrester arrays 20X1, 20X2 from opposite ends of the casing 2. Thus, referring to FIG. 1, the arrester array 20X1 is mounted on the support plate 9, and connected via the insulating cylinders 8 to the installation plate 7A and end plate 4A, and is inserted from the right-hand side of the casing 2 in FIG. 1. Similarly, the arrester array 20X2 is mounted on the mounting plate 7B, and on the end plate 7B, and is inserted from the left-hand side in FIG. 1. The connection plates 12A, 12B are then connected together. Such a construction method has the advantage that less stress is applied to the arrester arrays 20X1, 20X2, and to the connection member 12, than would occur if the arrester arrays 20X1, 20X2 were connected together outside the casing 2, and were then inserted into the casing 2 from one end thereof.

What is claimed is:

1. An arrester comprising a plurality of laminated columns arranged in parallel, each of said-plurality of laminated columns having a plurality of non-linear conduction elements, electrical connection members electrically connecting said plurality of laminated columns, and a support column extending parallel to said plurality of parallel laminated columns; wherein said plurality of parallel laminated columns are arranged around, and in contact with, said support column.

2. An arrester according to claim 1, having four parallel laminated columns.

3. An arrester according to claim 1, wherein said support column is hollow.

4. An arrester according to claim 1, wherein each of said plurality of non-linear conduction elements is annular, and each of said plurality of parallel laminated columns includes an elongate insulating core supporting said non-linear conduction elements.

5. An arrester according to claim 1, wherein each of said plurality of parallel laminated columns also includes insulating spacers, and at least one insulating spacer of one of said plurality of parallel laminated columns is rigidly connected to at least one insulating spacer of another of said plurality of parallel laminated columns by insulating material.

6. An arrester according to claim 5, wherein said insulating material contacts said support column.

7. An arrester assembly comprising:

an arrester having a plurality of laminated columns arranged in parallel, each of said plurality of laminated columns having a plurality of non-linear conduction elements, electrical connection members electrically connecting said plurality of laminated columns, and a support column extending parallel to said plurality of parallel laminated columns; wherein said plurality of parallel laminated columns are arranged around, and in contact with, said support column; and a casing enclosing said arrester, said casing being filled by an insulating gas.

8. An arrester comprising a plurality of laminated columns arranged in parallel, each of said plurality of laminated columns having a plurality of non-linear conduction elements, and connection members electrically connecting said plurality of laminated columns; wherein each of said plurality of laminated columns also includes insulating spacers, and at least one insulating spacer of one of said plurality of parallel laminated columns is rigidly connected to at least one insulating spacer of another of said plurality of laminated columns by insulating material.

9. An assembly comprising a plurality of laminated columns arranged in parallel, each of said plurality of laminated columns having a plurality of non-linear conduction elements, and connection members electrically connecting said plurality of laminated columns, wherein each of said plurality of laminated columns also includes insulating spacers, and at least one insulating spacer of one of said plurality of laminated columns is rigidly connected to at least one insulating spacer of another of said plurality of laminated columns by insulating material; and a casing enclosing said arrester, said casing being filled by an insulating gas.

10. An arrester assembly comprising:

a plurality of laminated columns arranged in parallel, each of said plurality of laminated columns having a plurality of non-linear conduction elements;

connection members electrically connecting said plurality of laminated columns; and a shield ring surrounding said plurality of laminated columns, said shielding ring having a first ring connected to said plurality of laminated columns, and a second ring electrically connected to the first ring so that said first and second rings have the same potential as each other.

11. An arrester assembly comprising:

a plurality of laminated columns arranged in parallel, each of the plurality of columns having a plurality of non-linear conduction elements;

connection members electrically connecting said plurality of laminated columns;

a support column extending parallel to said plurality of laminated columns, said plurality of laminated columns being arranged around, and in contact with, said support column; and a shield ring surrounding said plurality of laminated columns, said shielding ring having a first ring connected to said plurality of laminated columns, and a second ring electrically connected to the first ring so that said first and second rings have the same potential as each other.

12. An arrester assembly comprising:

a plurality of arresters, each arrester having a plurality of laminated columns arranged in parallel, each of said plurality of laminated columns having a plurality of non-linear conduction elements, connection members electrically connecting said plurality of laminated columns, and a support column extending parallel to said plurality of laminated columns; wherein said plurality of laminated columns are arranged around, and in contact with, said support column; and a further support column;

wherein said further support column is parallel to each of said plurality of laminated columns of each of said arresters, and at least one of said plurality of laminated columns of each of at least two of said plurality of arresters are in contact with said further support column.

13. An arrester assembly according to claim 12, wherein said further support column has a diameter which is less than the diameter of said support column of each of said plurality of arresters.

14. An arrester assembly according to claim 12, further comprising a plurality of said further support columns, wherein each of said further support columns is parallel to each of said laminated columns, and wherein each of said further support columns contacts at least two of said laminated columns.

15. An arrester assembly comprising first and second arresters, each of said first and second arresters comprising a plurality of laminated columns arranged in parallel, each of said plurality of columns having a plurality of non-linear conduction elements, and connection members electrically connecting said plurality of laminated columns; wherein said first and second arresters are arranged coaxially and are electrically connected together by connection means.

16. An arrester assembly according to claim 15, also including a casing enclosing said first and second arresters, said casing being filled with an insulating gas.

17. An arrester assembly according to claim 16, wherein said plurality of parallel laminated columns of said first and second arresters extend horizontally, and there is a recess in the interior of a wall of said casing.

18. An arrester assembly according to claim 14, wherein said first arrester is connected to said casing by an insulating member.

19. A method of forming an arrester assembly, said arrester assembly having first and second arresters, each of said first and second arresters comprising a plurality of laminated columns arranged in parallel, each of said plurality of laminated columns having a plurality of non-linear conduction elements, connection members electrically connecting said plurality of laminated columns, and a casing enclosing said first and second arresters;

said method comprising:

inserting said first arrester into said casing from a first direction;

inserting said second arrester into said casing from a second direction opposite to said first direction;

securing said first and second arresters together via connection means;

sealing said casing; and filling said casing with an insulating gas.

* * * * *